US007650843B2

(12) United States Patent
Minges

(10) Patent No.: US 7,650,843 B2
(45) **Date of Patent: *Jan. 26, 2010**

(54) RAIL MOUNTED TRAVERSING TRANSPORT

(75) Inventor: Marcus C. Minges, Birmingham, AL (US)

(73) Assignee: Incline Access, LLC, Tuscaloosa, AL (US)

( * ) Notice: Subject to any disclaimer, the term of this patent is extended or adjusted under 35 U.S.C. 154(b) by 0 days.

This patent is subject to a terminal disclaimer.

(21) Appl. No.: 10/705,342

(22) Filed: Nov. 10, 2003

(65) Prior Publication Data

US 2004/0168605 A1 Sep. 2, 2004

Related U.S. Application Data

(62) Division of application No. 09/659,619, filed on Sep. 11, 2000, now Pat. No. 6,666,147.

(51) Int. Cl.
*B61B 7/00* (2006.01)

(52) U.S. Cl. ..... 104/178; 104/180; 105/30; 105/155

(58) Field of Classification Search ..... 105/30, 105/155, 75, 164, 153; 104/93, 112, 113, 104/178, 180, 117, 127, 173.1, 173.2, 130.04, 104/128, 121; 187/201, 245
See application file for complete search history.

(56) References Cited

U.S. PATENT DOCUMENTS

| | | | | |
|---|---|---|---|---|
| 243,244 | A | 6/1881 | Goodell | |
| 620,801 | A | 3/1899 | Pratt | |
| 1,101,910 | A | 6/1914 | Elmqvist | |
| 1,969,276 | A | 8/1934 | Pevear | |
| 2,507,887 | A * | 5/1950 | Cheney | 187/201 |
| 2,528,265 | A * | 10/1950 | Cretors | 187/201 |
| 2,612,238 | A | 9/1952 | Angelicola | |
| 2,632,402 | A * | 3/1953 | Reussner | 104/173.2 |
| 2,798,267 | A | 7/1957 | Anderson | |
| 3,168,937 | A | 2/1965 | Redford | |

(Continued)

FOREIGN PATENT DOCUMENTS

| | | |
|---|---|---|
| DE | 9320592 | 1/1995 |

(Continued)

OTHER PUBLICATIONS

European Patent Office; Supplementary European Search Report dated Apr. 16, 2008 (search completion date Apr. 8, 2008) in application EP 05733240 (an application by the same inventor).

(Continued)

*Primary Examiner*—S. Joseph Morano
*Assistant Examiner*—Robert J McCarry, Jr.
(74) *Attorney, Agent, or Firm*—Bradley Arant Boult Cummings LLP

(57) ABSTRACT

A transportation system is provided that accommodates varying angles of slope along the path of its movement, while maintaining a level transportation platform without the need of mechanical leveling devices or systems. The platform may be connected to the rail by wheels that are held in a substantially fixed relationship to one another, the closest of which to the platform is above the rail, and the other below the rail. Accordingly, the platform is torqued downward to maintain contact between the wheels and the rail. As the slope of the terrain, and thus the slope of the rail, increases, the rail is widened to maintain the platform at level. As the slope decreases, the rail is narrowed to the same effect. The platform also may be tilted for loading or unloading by this rail-widening method, as may be desired.

5 Claims, 8 Drawing Sheets

U.S. PATENT DOCUMENTS

| | | | | | |
|---|---|---|---|---|---|
| 3,176,628 | A | | 4/1965 | Reid | |
| 3,533,357 | A | | 10/1970 | Brandon | |
| 3,670,659 | A | | 6/1972 | Schurch | |
| 3,735,709 | A | | 5/1973 | Matsumoto et al. | |
| 3,774,548 | A | | 11/1973 | Borst | |
| 3,818,836 | A | | 6/1974 | Swilley | |
| 3,891,062 | A | | 6/1975 | Geneste | |
| 3,935,822 | A | | 2/1976 | Kaufmann | |
| 4,015,537 | A | | 4/1977 | Graef et al. | |
| 4,026,388 | A | | 5/1977 | Creissels | |
| 4,278,165 | A | | 7/1981 | Nielsen | |
| 4,550,806 | A | | 11/1985 | Bocker | |
| 4,602,567 | A | | 7/1986 | Hedstrom | |
| 4,613,270 | A | | 9/1986 | Konstant et al. | |
| 4,627,517 | A | | 12/1986 | Bor | |
| 4,821,845 | A | | 4/1989 | DeViaris | |
| 4,961,385 | A | * | 10/1990 | Abouzakhm | 104/113 |
| 5,069,141 | A | * | 12/1991 | Ohara et al. | 105/30 |
| 5,231,933 | A | * | 8/1993 | DiRosa | 105/73 |
| 5,398,617 | A | | 3/1995 | Deanndrea | |
| 5,419,260 | A | | 5/1995 | Hamilton | |
| 5,476,155 | A | * | 12/1995 | Nakatani et al. | 187/202 |
| 5,533,594 | A | * | 7/1996 | Tremblay et al. | 187/201 |
| 5,572,930 | A | | 11/1996 | Hein | |
| 5,676,189 | A | | 10/1997 | Zeeb | |
| 5,713,432 | A | | 2/1998 | Richter et al. | |
| 5,964,159 | A | | 10/1999 | Hein | |
| 5,967,265 | A | * | 10/1999 | Bruno et al. | 187/201 |
| 6,053,286 | A | | 4/2000 | Balmer | |
| 6,178,891 | B1 | | 1/2001 | Ostholt et al. | |
| 6,237,705 | B1 | * | 5/2001 | Nakatani et al. | 180/8.2 |
| 6,240,851 | B1 | | 6/2001 | Oudakker et al. | |
| 6,539,876 | B1 | | 4/2003 | Campbell et al. | |
| 6,666,147 | B1 | | 12/2003 | Minges | |

FOREIGN PATENT DOCUMENTS

| | | | |
|---|---|---|---|
| EP | 317782 | A1 * | 5/1989 |
| EP | 0317782 | | 10/1989 |
| WO | WO92/20604 | | 11/1992 |
| WO | WO 02/22422 | | 3/2002 |

OTHER PUBLICATIONS

European Patent Office; Supplementary European Search Report dated Jun. 19, 2008 (search completion date Jun. 11, 2008) in application EP 01962270 (an application by the same inventor, claiming priority to the parent of the current application).

* cited by examiner

RAIL MOUNTED TRAVERSING TRANSPORT

This application is a Divisional of prior filed U.S. patent application Ser. No. 09/659,619, filed Sep. 11, 2000, now U.S. Pat. No. 6,666,147, and claims the benefit and priority of such prior application, which is hereby incorporated by reference.

BACKGROUND OF THE INVENTION

1. Field of the Invention

This invention relates generally to solutions for moving people or items from one location to a higher or lower location along a variable slope without the need for complex leveling mechanisms. More particularly, the invention is directed toward outdoor transportation devices for moving people and things between elevated lake lots and the waterline in a safe and efficient manner along an incline that may vary substantially in slope.

2. Description of Related Art

Water-level lake lots are available for purchase with increasing rarity, and at increasingly inflated prices, substantially reducing the affordability of lake lot vacation or residential homes for all but the wealthy. At the same time, the vast majority of property bordering lakes is undeveloped and has heretofore in many cases been deemed undesirable or even undevelopable because of the grade or obstacles present between the waterline and a suitable location for building a house: The difficulties associated with getting to the focal point of such lots—the water—typically prevent the lot from being maximized as a leisure area, or from ever being useable at all for persons with special needs.

Numerous solutions have been advanced to address this problem, none of which are entirely acceptable. Such solutions range from the traditional winding stairs, which can be exhausting or even dangerous for the elderly, infants, and those with special needs, to typically traction cable-lift transport designs. Even these mechanical transports are limited in their application, being by their nature confined to either of two models: (1) a constant slope incline model, or (2) mechanically leveled models that involve moving linkages and machinery to maintain the surface of a transport platform at a relatively level position. In addition to these limitations, the inventor believes these solutions have not obtained the greatest degree of safety that potentially may be developed from alternative solutions such as the invention taught herein.

With the exception of stairs, the most commonly used transportation device in the art of elevated lake lot traversing is the cable-driven hoist platform. Such hoist platforms are exemplified by U.S. Pat. No. 3,168,937 to Redford, et al, which, although here applied to an indoor application, discloses a slope-moving meat cutting platform. Redford employs a constant slope dual rail design having a platform cantilevered between a wheel residing beneath the rail and another wheel disposed above the downward portion of the rail. Additionally, as the slope of the rails is not dependent upon any external factors, Redford shows a constant slope for the rails and includes no leveling mechanism; the teaching of Redford is therefore limited to extremely narrow applications. Redford's device is cable driven and therefore subject to heightened maintenance and safety concerns of such cable systems.

The art has recognized that not all applications enjoy a static slope, but has grappled with the solution. For instance, devices for ascending along stairs frequently must traverse not only fixed inclines, but also cross over flattened areas where landings are interspersed in the stairway. Designs accommodating variable slopes include the Hein inventions, U.S. Pat. Nos. 5,964,159 and 5,572,930. These stair alternatives incorporate a pair of rails separated by a constant vertical gauge. Leveling is achieved by rotating wheels that lie above and below each rail in a manner that keeps the wheels vertically aligned. Other leveling solutions include elevated transports that level loads strictly by gravity, the loads being suspended from a pivotable linkage, as in U.S. Pat. No. 3,935,822 to Kaufmann. Additional solution concepts for leveling include U.S. Pat. No. 5,069,141 to Ohara, U.S. Pat. No. 4,602,567 to Hedstrom; and U.S. Pat. No. 3,774,548 to Borst, each of which to varying degrees depends upon a hanging load below the level of the rail. The typical hanging load system requires the weight to be centered on the platform; otherwise, the stability and consistency of leveling will be suspect. These systems are subject to undesirable swaying motion, particularly at sudden starts and stops. Additionally of note are solutions for horizontal leveling systems that employ a complex array of tracks and multiple wheels that variously engage and disengage from their respective tracks as movement progresses, such as the "traversing elevator" described in U.S. Pat. No. 4,821,845.

Other developers have noted difficulty with obtaining reliable and consistent grip between the rails of a transport and the wheels when on a slope. The art has variously attempted to address this difficulty by use of spring loaded wheels, such as those shown in Ohara et al, U.S. Pat. No. 5,069,141, or by gripping teeth, as in U.S. Pat. No. 5,398,617, issued to Deandrea.

None of these prior art systems has maximized the potential available for reliable self leveling traversing devices. It further will be noted by those reasonably skilled in the art that the more complex the leveling, gripping, or safety system becomes, the greater the number of practical issues that arise, such as the expense of manufacture of additional components and the fact that additional components increase the potential for unacceptable failure. The present invention is capable of being practiced without such complexity, though if desired the invention can be practiced in complex embodiments while still maintaining the spirit of the invention.

OBJECTS OF THE INVENTION

The following stated objects of the invention are alternative and exemplary objects only, and should not be read as required for the practice of the invention, or as an exhaustive listing of objects accomplished.

As suggested by the foregoing discussion, an exemplary and non-exclusive alternative object of this invention is to provide a transportation device capable of delivering people and articles between a waterline and an elevated lake lot.

A further exemplary and non-exclusive alternative object is to provide a reliable self-leveling transportation device that does not rely solely upon dynamic control or hanging suspension to achieve leveling.

A still further exemplary and non-exclusive alternative object of the invention is to provide a self-leveling transportation device in which, following installation, a failure to level as desired is virtually impossible absent catastrophic damage to the device.

A further exemplary and non-exclusive alternative object of the invention is to provide a transportation device that does not rely upon pulleys or cables.

Yet another exemplary and non-exclusive alternative object of the invention is to provide a transportation device that is unobtrusive and exhibits a small elevation, profile, and footprint on a lake-lot slope.

The invention additionally may allow, in an exemplary and non-exclusive alternative, for a more direct route between a lake lot and the waterline, without the need for a winding path.

The invention is further capable in some exemplary and non-exclusive alternative embodiments of providing an efficient and safe transportation system for adults, children, riders, and bystanders.

The invention is further able to provide in some exemplary and non-exclusive alternative embodiments a lake-lot transportation system that is conveniently located for easy boarding and debarking at nearly ground levels at both the top and bottom of a slope.

The above objects and advantages are neither exhaustive nor individually critical to the spirit and practice of the invention. Other or alternative objects and advantages of the present invention will become apparent to those skilled in the art from the following description of the invention.

BRIEF SUMMARY OF THE INVENTION

The present invention may be described -basically as a self leveling transport device with application for delivering people and their accessories between an elevated lake lot and the water line. The transport may be adapted to be low profile against the silhouette of a land slope, increasing attractiveness of the entire surrounding area. The device is able to adjust the "attitude" of a load or platform by selectively leveling, or causing to be off level, the load or platform (relative to a horizontal plane, the ground, or other selected orientation or parameter).

Unlike previous rail-mounted systems, the current invention does not require either a constant slope of the incline, or a mechanico-electrical leveling-adjustment system. Rather, within reasonable limits, the rail may be run, if desired, in a straight line (viewed from the water) from the top of an incline to the bottom, hugging the contour of the earth surface the entire distance. This lowers the dangers associated with elevated portions of track that may become necessary for maintaining a constant slope in prior art systems.

The present invention employs a support body platform (which may be a floor bucket, chair, or any other supporting or holding device, including pinchers) connected to a rail by wheels or other traversing members, such as wheels, rollers, bearings, tracks, skids (particularly low-friction skids). One traversing member contacts the rail from below, and a second traversing member contacts the rail from above. Typically, this places the second traversing member both horizontally and vertically offset from and above the first traversing member, when viewed from the side. The platform is connected to the second traversing member and extends over the downslope side of the rail. This creates a cantilevered, or torqued design, in which the center of gravity of the loaded platform is on the opposite side of the second traversing member from the first traversing member, and in which the platform is above the level of the rail. Accordingly, as weight on the platform is increased, the torque increases the effectiveness of friction between traversing members and rail. The present invention can therefore in some embodiments rely wholly upon friction of the traversing members to maintain location upon the rail within preferred operational parameters. The system is therefore amenable to cableless direct drive operation in embodiments using wheels or tracks at the traversing members, in contrast to many prior art devices.

It should be noted that the location of the center of gravity of the platform may change in various states of loading or unloading; it is possible to take advantage of such change by allowing for a shift of the center of gravity to the opposite side of the second traversing member, allowing for easy removal of the platform, maintenance of the traversing members or other equipment, storage, etc.

In order to achieve reliable and durable self-leveling, neither the traversing members nor the angle among the traversing members and the platform needs to be variable; rather each of these can be hard-welded or secured in any other static fashion. Self leveling is effected in the present invention by varying the vertical gauge of the rail (by "vertical gauge," or "gauge" hereinafter, is meant the distance from a point On the upper surface of the rail to the closest point on the undersurface of the rail). At any given distance between the traversing members, the cantilever effect causes a wider gauge rail to urge the line between the traversing members to approach perpendicular to the top of the rail. A thinner gauge rail will allow the line between the traversing members to pivot away from perpendicular to the rail, towards an angle that is limited in its acuteness by the configuration of the traversing members (e.g., where wheels are employed as the traversing member, the radial height of the wheels will affect the acuteness of angle obtainable) and the gauge of the rail. Accordingly, the user can determine from the minimum desired gauge of the rail and the configuration (e.g., minimum radius of wheels) of the traversing members, how far off of parallel the line between the traversing members will be from the rail at its most horizontal point. The platform can thereafter be attached to the traversing members in such a way that the fixed angle among the traversing members and the platform results in a horizontally level platform at the most horizontal point on the rail. As the rail becomes more vertically disposed traveling along its length, the platform may be maintained at a horizontal level by widening the gauge of the rail, which will drive the line—and thus the platform—into a changing relationship with the rail to compensate for the increasing slope.

The present invention overcomes the chief limitations of static slope requirement systems, while avoiding complex linkages and mechanical systems.

DETAILED DESCRIPTION OF THE INVENTION

The following is a detailed description of the invention. Those skilled in the art will understand that the specificity provided herein is intended for illustrative purposes with respect to the inventor's preferred and most preferred embodiments, and is not to be interpreted as limiting the scope of the invention. It must be understood without limitation that the term "rail" as used herein encompasses such variants of rails as may be substitutable for rails, such as tracks, beams, planks, pipes, runners, or other weight-bearing guidance configurations; additionally, within the meaning of "rail," a single rail or two separate rails may be used to present an upper surface for meeting the downward component of torque or cantilever forces and a lower surface to meet the upward component of torque or cantilever forces. Furthermore, although these embodiments tend to show wheels as the selected traversing members, it must be understood that other traversing members will work equally well within the scope of the invention. As such, in the following exemplary embodiments, wheels must be understood as substitutable by conveyor tracks, bearings, skids, skis, and rollers or any other traversing member.

Figure 1:
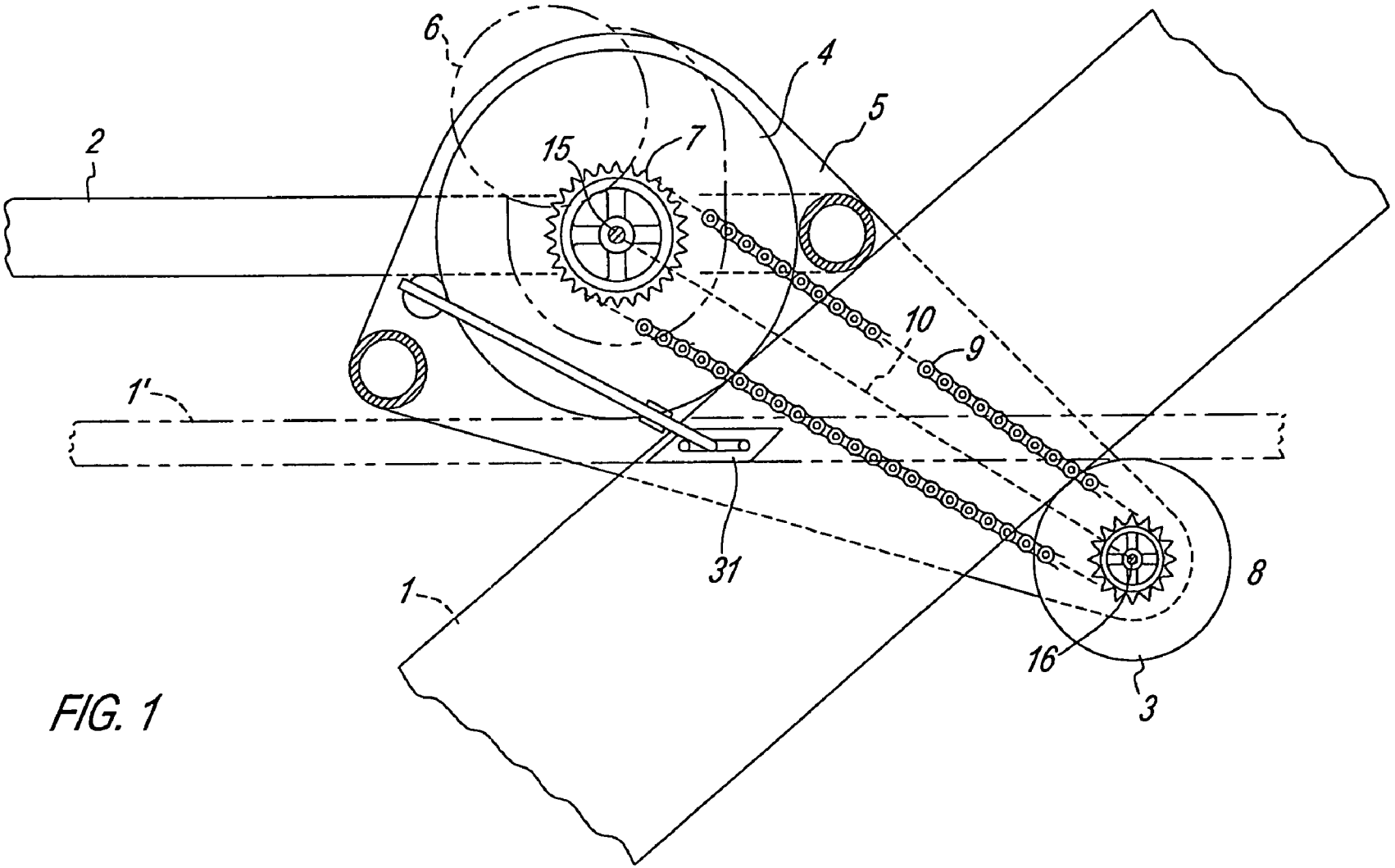
FIG. 1 shows a diagram of the intersection of traversing members, rail, and platform of the current invention in an embodiment in which the traversing members are wheels.
Figure 2:
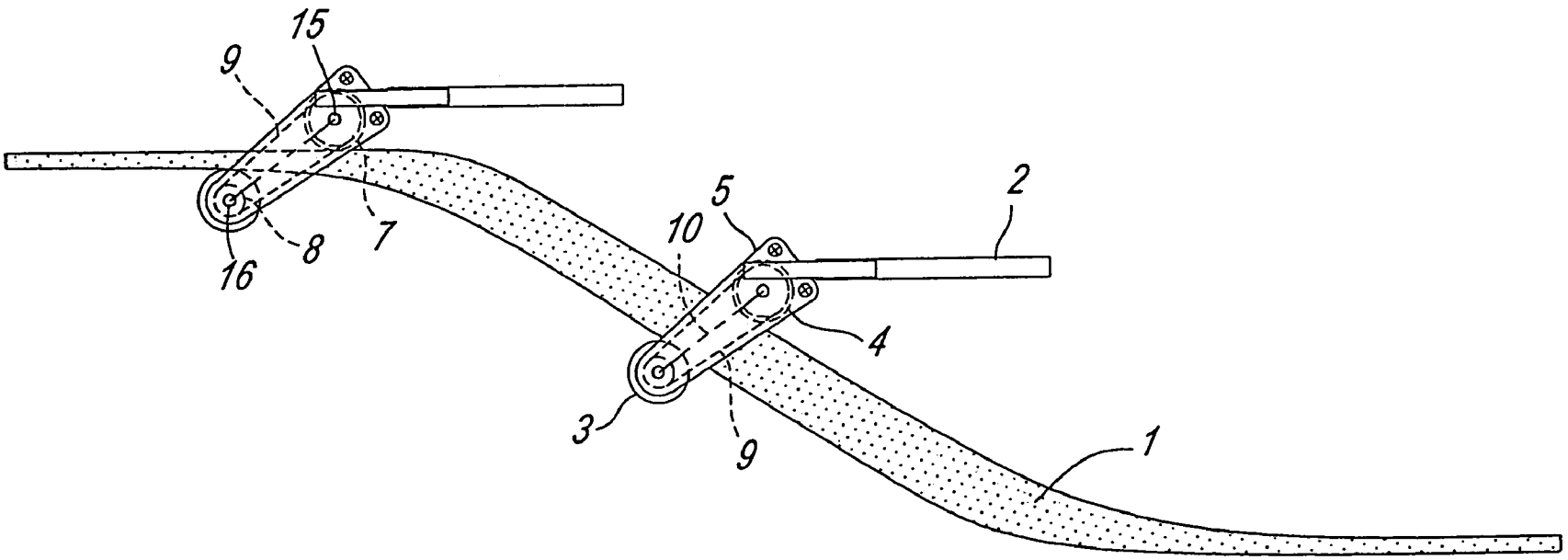
FIG. 2 depicts the transport device of the present invention at two distinct locations on the rail, and demonstrates the varying vertical gauge of the rail to effect self-leveling motion of the device.
Figure 3:
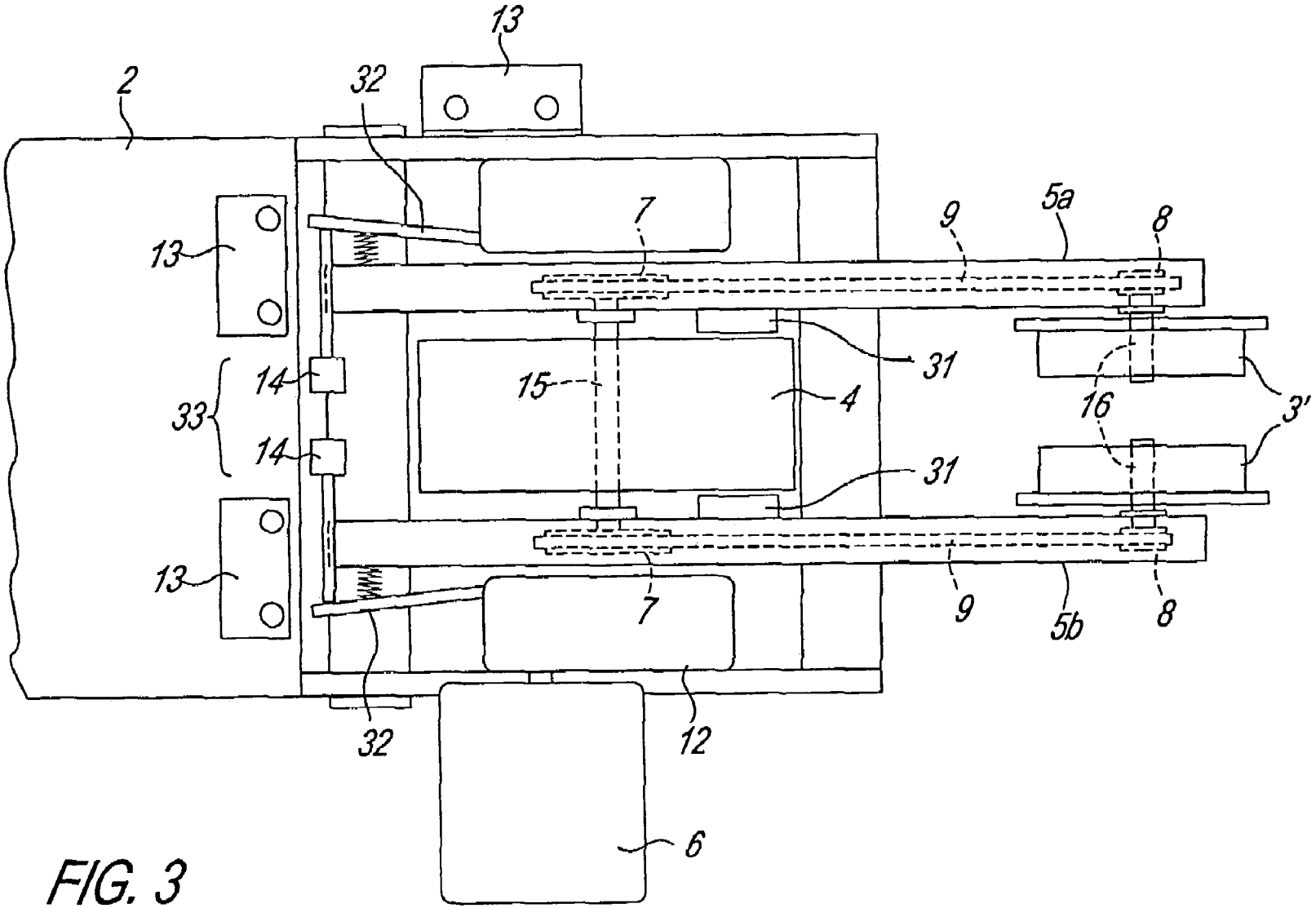
FIG. 3 is a schematic of the device of the current invention as viewed from above, in the absence of a supporting rail.
Figure 4:
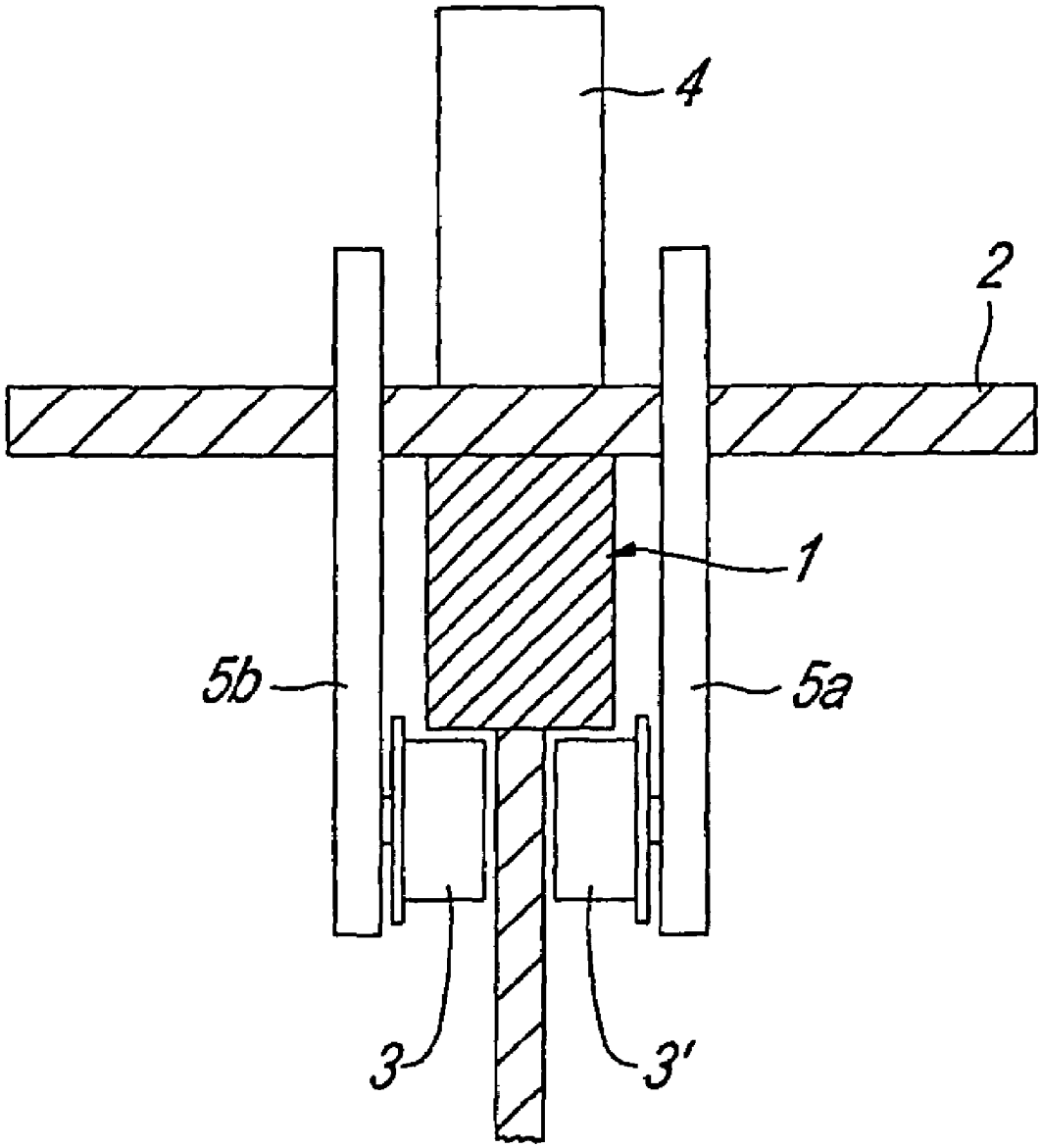
FIG. 4 is a drawing of a frontal view of the device of the present invention, as seen along the line of view in plane with the rail.

Turning now to the drawings, FIGS. 1 and 2 are best viewed together. FIG. 1 presents a diagram of the intersection of traversing members, rail, and platform according to the current invention, wherein wheels have been substitutably chosen as traversing members. FIG. 2 shows this intersection from a greater distance to demonstrate the built-in leveling of the device along the rail. Rail 1 is shown at a point along its slope. For ease of contrast, rail 1 is also shown at a different location by dashed line as rail 1', having a substantially horizontal slope. Considering rail 1 as shown in solid lines, traversing members overwheel 4 and underwheel 3 are in communication with rail 1 on opposite sides. Overwheel 4 and underwheel 3 are retained in substantially fixed relationship to one another by means of housing 5, which may comprise two sides 5*a* and 5*b*, disposed in rigid separation from one another, which provide support for and operative restraining of axles 15 and 16 of overwheel 4 and underwheel 3, respectively. The relationship between overwheel 4 and underwheel 3 is characterized by an imaginary line 10 running between the center of each.

Housing 5 connects traversing members overwheel 4 and underwheel 3 to a platform 2. Platform 2 is adapted to support items and persons intended to be transported by the device, and may accordingly be of any configuration desired. Such desired configurations frequently will benefit from having a bottom support plane that remains substantially horizontally level. For convenience of description, platform 2 is here shown as a wide plank. As will be readily understood, when configured as a plank, the plane including the lowest point of support of materials being transported is coincident with the top of the plank. Disposed between overwheel 4 and underwheel 3 is rail 1. Viewing FIGS. 1 and 2, due to the presence of platform 2 and any load thereon, overwheel 4 acts as a fulcrum resting on rail 1 with respect to the force exerted by such load. Underwheel 3, in turn, being on the opposite side of the overwheel 4 fulcrum point from the center of gravity of the loaded platform 2, is driven upwards toward the underside of rail 1. Accordingly, as the load on platform 2 increases, overwheel 4 and underwheel 3 are driven into increasingly loaded contact with rail 1. The device thus dynamically responds to loads by increasing wheel-to-rail grip in a manner that obviates the need for cables or continuous loop friction hoists (though such additional or alternative drives may be included). Rather, when, as here, wheels or conveyor tracks are selected as traversing members, the wheels may be driven by an on board engine or motor 6. Advantageously, in some embodiments this may increase the safety factor of the device by avoiding cables that are subject to high stress and wear in the prior art, and that require constant and diligent maintenance.

Figure 7:
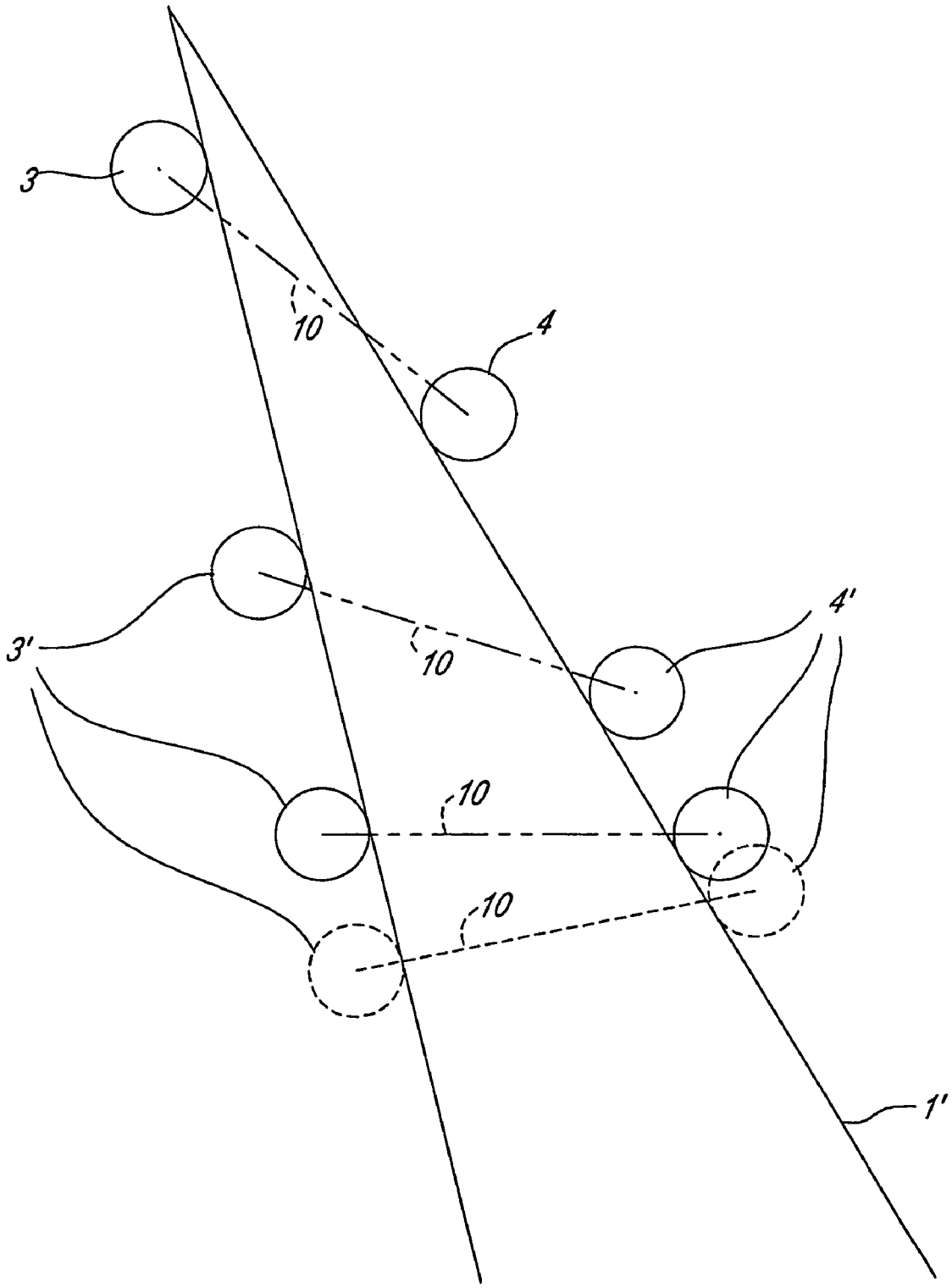
FIG. 7 demonstrates the mechanism of operation of the invention in a basic format.

FIG. 7 demonstrates the mechanism of leveling action of the present invention. Variously positioned overwheels 4' and underwheels 3', having for purposes of this illustration an identical distance between axes of rotation to that of first-shown overwheel 4 and underwheel. 3, are shown at different points along a sloped rail 1' of varying gauge. Imaginary line 10 is drawn between the axes of rotation of each set of wheels for clarity. At the highest point shown, the gauge of rail 1' is relatively narrow. Because the distance between overwheel 4' and underwheel 3' is greater than the gauge of rail 1' at this point, imaginary line 10 rotates clockwise until both overwheel 4' and underwheel 3' are in contact with rail 1'. Moving to the next lower view of the coupled wheels, the extent of clockwise rotation of imaginary line 10 is reduced due to a greater gauge of rail 1', which causes overwheel 4' and underwheel 3' to come into contact with rail 1' at an earlier point of rotation. The still next lower view demonstrates that as the gauge of rail 1' approaches the same value as the closest distance of separation between overwheel 4' and underwheel 3', imaginary line 10 approaches perpendicular to the top face of rail 1'. Finally, the lowest view of coupled wheels shows a position in which the gauge of rail 1' is equal to the distance separating the closest points of overwheel 4' and underwheel 3'; in this situation, imaginary line 10 is perpendicular to rail 1'.

Figure 8:
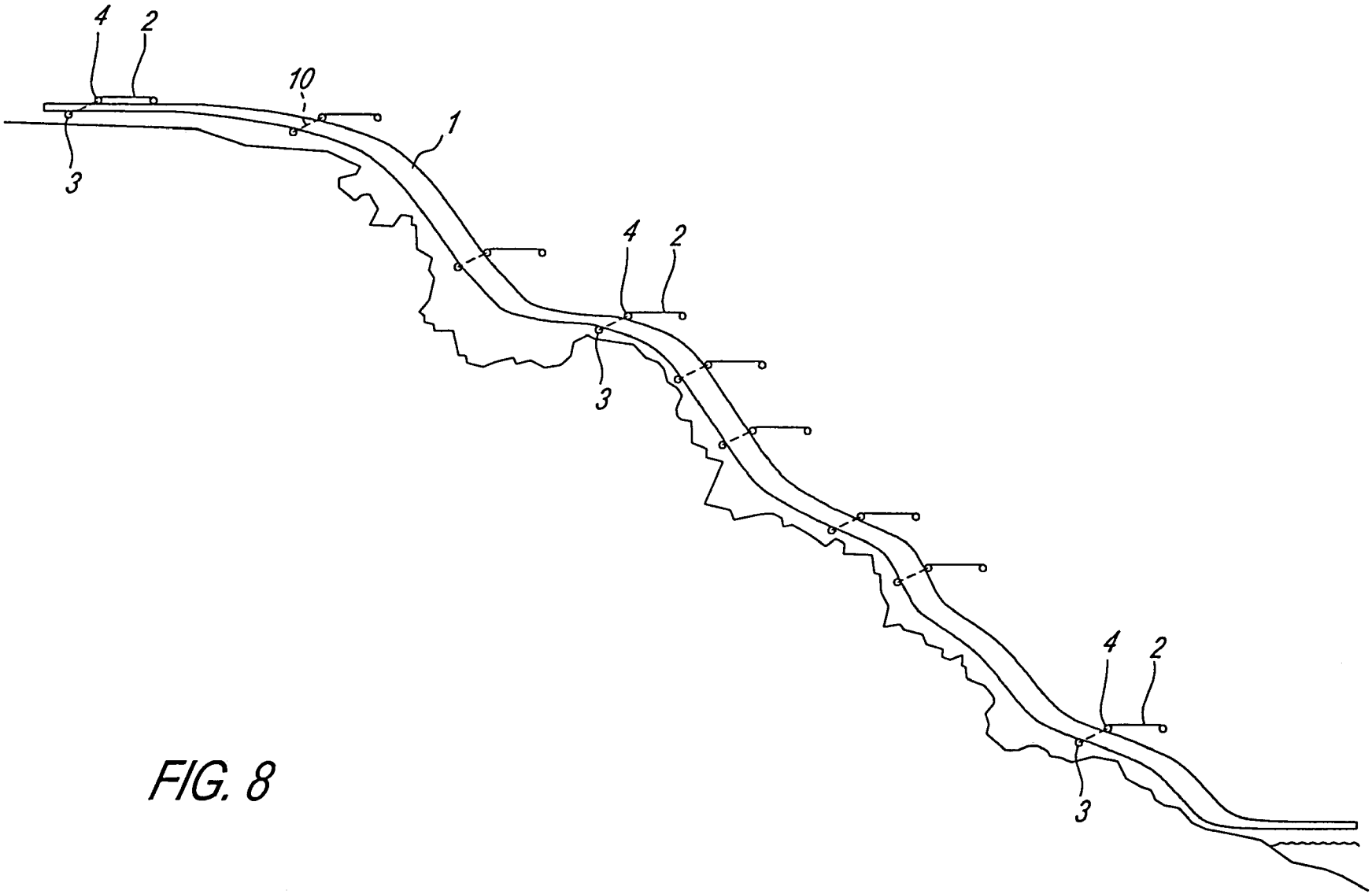
FIG. 8 shows the invention along an elevated landscape profile, with the transportation device depicted at various locations.

The basic operative characteristics of the invention as seen in FIG. 8 may be summarized as follows. Overwheel 4 and underwheel 3 maintain a substantially constant distance from one another. The angle between platform 2 and imaginary line 10 remains substantially constant, requiring no mechanical leveling apparatus. Rail 1 may at no point of intended travel of the device be wider (the gauge may not be greater) than the distance between overwheel 4 and underwheel 3. As the gauge of rail 1 increases toward this maximum, the amount of rotation of imaginary line 10 about the plane containing rail 1 is affected in the following manner: as rail 1 increases in gauge, the angle between the top of rail 1 (or the tangent of the top of rail 1 where rail 1 is curving) and imaginary line 10 approaches perpendicular (90 degrees). As the gauge of rail 1 decreases from the maximum, the angle between the top of rail 1 and platform 2 will decrease, while the angle between platform 2 and imaginary line 10 remains constant. Thus, by varying the gauge of rail 1 to a coordinating degree as the slope of rail 1 changes, platform 2 may be maintained at horizontal. (Of course, by varying the gauge to a greater or lesser degree may allow different angles of tilt of platform 2 as may be intended for differing purposes).

FIG. 8 shows how the present invention builds upon the effect demonstrated above. In FIG. 8 a wheel is shown at the end of platform 2 for supporting platform 2 on rail 1 when both rail 1 and platform 2 are horizontally disposed. By increasing the gauge of rail 1 as the slope of the rail increases, platform 2 attached to housing 5 is maintained at level. As described above, the distance between overwheel 4 and underwheel 3 is substantially constant. In one embodiment, when platform 2 is level the top of underwheel 3 and the bottom of overwheel 4 will be separated by a vertical distance (not necessarily the length of imaginary line 10) at least as great as the largest vertical gauge of rail 1 at any point along which the transport device is intended to travel with a level platform 2. If the operator desires that at some point along the path of travel, the end of platform 2 furthest from rail 1 should dip below the end of platform 2 that is closest to rail 1, the vertical separation of overwheel 4 and underwheel 3 should be greater than the gauge of rail 1 at that point. Similarly, if the operator desires that the end of platform 2 furthest from rail 1 be above the end of platform 2 that is closest to rail 1 at some point, the vertical separation of overwheel 4 and underwheel 3 should be less than the gauge of rail 1 at that point.

For reliability and efficiency reasons, though not always necessary, a common embodiment of the invention will not traverse greater than 40 degrees of variations in slope of rail 1. If the terrain traversed requires variations in slope of greater than 40 degrees, the path of rail 1 may "wind" up the slope by various cut-backs to prevent exceeding a 40 degree slope change. In a common embodiment, rail 1 will have a gauge of 2 inches at its most horizontal point. This is primarily due to the ready availability and economy of 2 inch square tubing from which rail 1 may be constructed. If the slope is to increase to a full 40 degrees, a 14 inch gauge may be used at such 40 degree slope, depending upon the separation configuration of overwheel 4 and underwheel 3 as maintained by housing 5.

Without limiting the manner of calculating the variations in gauge, slope, etc., the actual relationship between gauge and slope may be simplistically derived by diagraming a given wheel configuration at a point where the most horizontal slope meets the most vertical slope. Overwheel 4 is in such drawing placed immediately at the intersection of the two slopes on the upper side of rail 1 with platform 2 level. The proper gauge of rail 1 at the maximum slope for the particular wheel configuration may then be derived by diagraming the underside of rail 1 such that underwheel 3 is in contact there with. As noted above, in a common embodiment, this will provide for a 2 inch horizontal gauge, and a 14 inch gauge at 40 degree slope. The relationship between gauge and slope for such configuration is thus 1 inch of gauge change for every 3.3 inches of slop change. (E.g., rail 1 goes from 2 inches to 14 inches of gauge, a 12 inches change, as the slope traverses 40 degrees, meaning that the ratio of change is 12 inch: 40 degrees, or 1:3.3 inches: degree.) By this simple process it is possible to derive the desired variation in gauge at any slope along the path of rail 1. Those in the art will understand that it is possible to state various formulae and calculations for achieving the same effect, with even greater precision, but that such mathematics are limited by the chosen fixed relationship. The inventor notes that the relationship between the position of overwheel 4 and underwheel 3 may be first determined and fixed with reference to a level platform 2 at the most horizontal slope to be traversed. The relationship between imaginary line 10 and platform 2, as well as the magnitude of imaginary line 10 can thereafter be treated as fixed values. Of course, by fixing other values, such as maximum gauge, it is possible to solve for any of other values as may be desired.

In one embodiment, when platform 2 is level, the lower angle between platform 2 and imaginary line 10 is no less than 135 degrees (e.g., the angle between imaginary line 10 and level ground is 45 degrees or less).

In another aspect of an embodiment, rail 1 is manufactured in segments for easy transportation and assembly. Preferably, though not necessarily, the segments of rail 1 are continuous material, such as a beam or pipe. In accordance with the invention, however, a characteristic of rail 1 (other than those factors that are determined for external safety, code, and structural reasons) is that the distance between the top of rail 1 and the bottom of rail 1 be capable of varying. Such varying of the distance may be achieved by adding layers-or materials to rail 1 to build it up at desired locations, by "egging" a pipe outward, or by use of a separate top surface and bottom surface which together would operate as a single rail 1 within the meaning of the invention. Any other methods as may be known in the art may be used.

For purposes of increased simplicity or stability, a single rail 1 of rectangular cross section may be used, though two or more parallel rails 1 can be employed. Overwheel 4 is in the drawn embodiment a single tire, and is driven directly or by transmission linkage by motor 6. Attached to axle 15 of overwheel 4 is sprocket 7, which is in turn connected by means of a drive belt or chain 9 to sprocket 8 on underwheel 3. As motor 6 drives overwheel 4 and thus sprocket 7, sprocket 8 is accordingly also driven, which allows multiple-wheel drive of the device. Underwheel 3 as shown in this embodiment is achieved by use of two separate flanged wheels 3', having a radially outer frictional gripping surface for contact with the underside of rail 1, and an axially outer flange for preventing side-to-side slippage relative to rail 1. Applying such separate wheels 3' allows for a gap which can be positioned to allow passage of ground supports for rail 1 thereinbetween. Where more than one underwheel 3 is employed, sprockets may connect each underwheel 3' to a driven overwheel 4. The diagramed monorail configuration allows ready and stable turning.

No cables or traction hoists are required with the present invention. Accordingly, safety is not dependent upon frequency of change and inspection of cables. The increased traction afforded by the cantilever effect obviates this necessity. Although the drawn embodiments show the use of an onboard drive configuration, it is possible, of course, to configure the device to be driven primarily, or as a redundancy, by cable or traction hoist methods. In such an event, the cable may be housed within rail 1 in a manner allowing constant connection between the transport (preferably housing 5) and the cable, such as by means of a groove in rail 1. The use of a cable may therefore be added without substantially altering the operative configuration or external appearance of the device. Variable slope (and variable gauge) may be accommodated by use of guides and rollers as known in the art to prevent the cable from exiting rail 1, while still maintaining unimpeded traction hoist effect.

In yet another embodiment, safety may be integrated by means of brakes 31 that remain engaged in the absence of current. As is known, a solenoid 14 may be operated to electrically hold the brake pads open when current is applied. In the absence of current, such as battery failure, the brakes return to closed position, preventing uncontrolled descent along the slope of rail 1. The pads of brakes 31 may be positioned to prevent side-to-side slippage of overwheel 4, much as the flanges on underwheels 3', described above.

Motor 6 may be powered by batteries 13. In order to maximize efficiency, the system is designed for dynamic braking and to allow descent speed control by braking only, rather than employing the motor for descent. In such a configuration, it is possible and preferable to use the gravity-driven descent to turn the motor into a generator for charging the batteries. Accordingly, battery life may be substantially increased and efficiency maximized.

Figure 5:
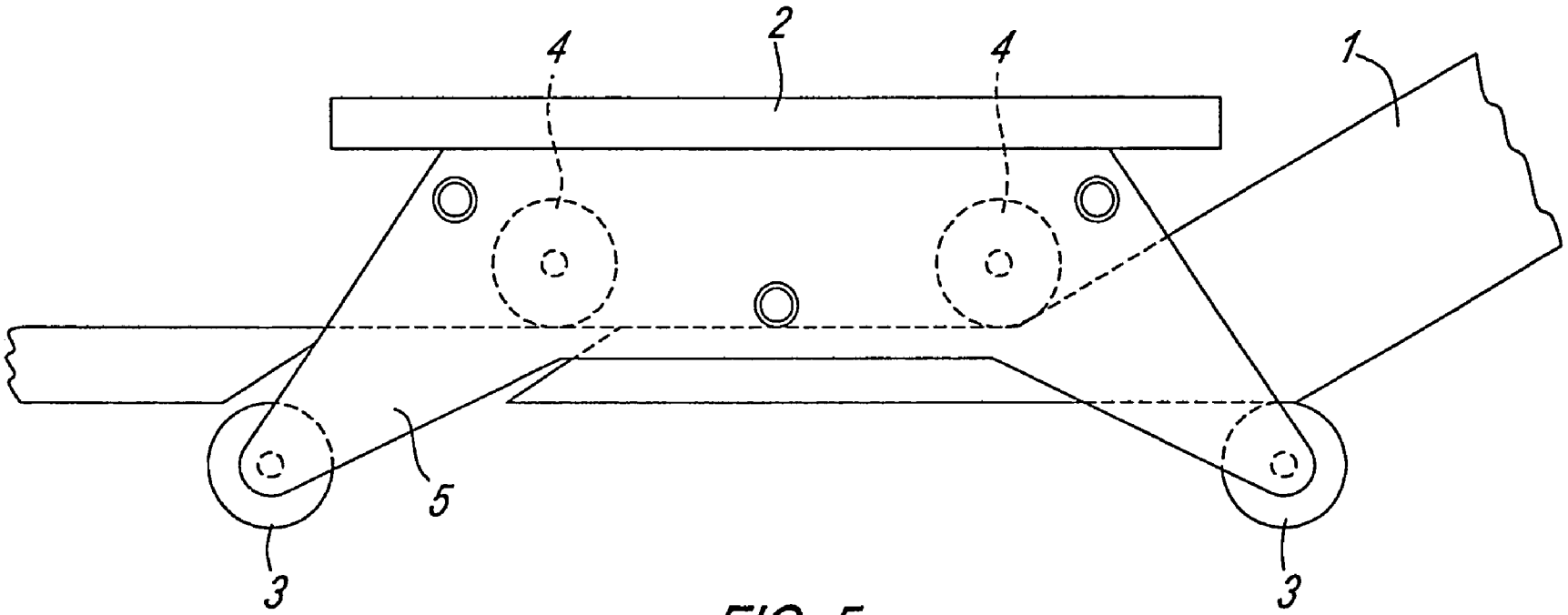
FIG. 5 is an alternative embodiment, having two sets of wheels as traversing members and two intersecting housings for allowing the device to travel over and beyond hills according to the principles of the invention.
Figure 6A:
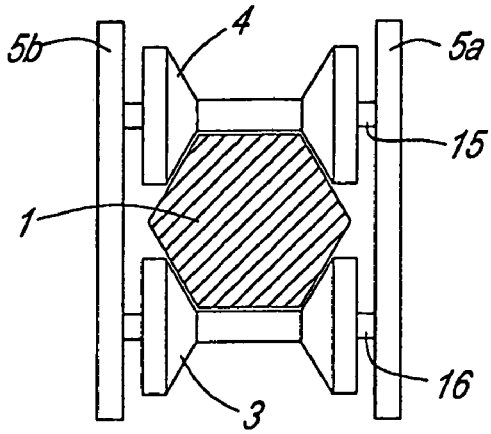
FIG. 6 sets forth alternative configurations for wheel-type traversing members of the current invention.
Figure 6B:
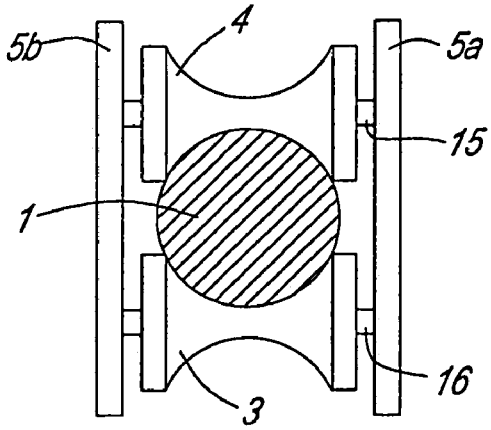
Figure 6C:
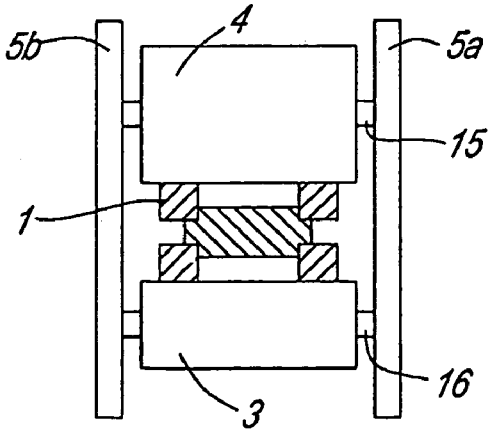

The invention as described above can be made in alternate embodiments to ascend and descend alternately facing slopes by means of creating notches for passing through of partial underwheels 3', as shown in FIG. 5. To effect the alternate slope traversing embodiment, an additional set of overwheel 4" and underwheel 3" is attached, having an angle of relationship to platform 2 extending in the opposite direction from first overwheel 4 and first underwheel 3. Each overwheel 4 and 4" can be made to exert pressure on rail 1 directly above rail 1 that is left between underwheels 3' and 3". At the beginning of the transition from one slope to the alternating slope, rail 1 is narrowed—preferably by cutouts approximating the path of travel of underwheels 3' or 3", respectively, through the plane of rail 1. A similar narrowing is constructed at the end of the transition area (which may overlap with the beginning of the transition area allowing for only one cutout, as seen in FIG. 5). By means of such a construction, the transportation device of the present invention is capable of moving up and down a series of hills. A similar effect may be achieved by offsetting overwheel 4" and underwheel 3", and by running a rail 1" in a manner that overwheel 4" and underwheel 3" engage or disengaged from rail 1" while overwheel 4 and underwheel 3 are engaged with rail 1, following which the latter disengage or engage, respectively.

Another alternative embodiment builds upon the recognition that even at a constant slope of rail 1, a user may desire platform 2 to tilt off of level. This may be for purposes of picking up materials, dropping off materials, or folding away an extended platform (e.g., as in a configuration having a platform that folds outwards at a hinge or hinges along its length). Such selective tilting of platform 2 may be achieved by the method of varying the gauge of rail 1 as taught in this invention, but to a greater or lesser degree than is required for maintaining a horizontal platform.

Other embodiments and advantages of the invention will be understood by those skilled in the art.

I claim:

1. A rail mounted transportation system comprising a. a rail, and b. a support body, said support body comprising 1. a load bearing platform above the rail and rigidly affixed to a wheel section,
2. within the wheel section, a closest wheel between the rail and the load bearing platform, and
3. a furthest wheel placed at a fixed distance from the closest wheel and separated from the closest wheel by the rail;

c. wherein said closest wheel is adapted to operate as a fulcrum with respect to a weight of said load bearing platform on one side thereof, and the furthest wheel to an opposite side thereof; and d. wherein the furthest wheel is adapted to transfer, in response to a weight of the load bearing platform urging the support body to pivot about said fulcrum, an upward force to a lower side of the rail by contact between said furthest wheel and said lower side of the rail.

2. A rail mounted transportation system comprising a. a rail, and b. a support body, said support body comprising 1. an upper wheel positioned to maintain downward force against the rail,
2. a lower wheel positioned to maintain upward force against the rail and separated from the upper wheel by the rail, and
3. a load bearing platform maintained in rigid relationship to the upper wheel and the lower wheel, with the load bearing platform closer to the upper wheel than to the lower wheel;

wherein the rail has a first inclined portion and a less inclined portion, in which the first inclined portion has a steeper slope than the less inclined portion, and wherein further the rail is thicker in vertical measurement at the first inclined portion than it is at the less inclined portion.

3. A rail mounted transportation system as in claim 2, wherein at least a part of the load bearing platform is directly over a downslope side of the rail.

4. A rail mounted transportation system as in claim 2, wherein there is a fixed angle between the load bearing platform and a line drawn between the upper wheel and the lower wheel.

5. A rail mounted transportation system comprising a. a rail, and b. a support body, said support body comprising 1. an upper wheel maintained in contact with an upward facing surface of the rail,
2. a lower wheel maintained in contact with a downward facing surface of the rail and separated from the upper wheel by the rail, and
3. a load bearing platform, wherein the load bearing platform is closer to the upper wheel than to the lower wheel wherein the rail has a greater inclined portion and a lesser inclined portion, in which the greater inclined portion has a steeper slope than the lesser inclined portion, and wherein an orientation, relative to the rail, of a line drawn between an axis of the upper wheel and an axis of the lower wheel, approaches perpendicular as a slope of the rail increases, and wherein further the load bearing platform is maintained in a fixed position relative to the line.

* * * * *